United States Patent [19]

Miyazaki et al.

[11] Patent Number: 5,043,901

[45] Date of Patent: Aug. 27, 1991

[54] AIR-FUEL RATIO CONTROLLER

[75] Inventors: Masaaki Miyazaki; Shinji Kojima; Hajime Kako, all of Himeji, Japan

[73] Assignee: Mitsubishi Denki Kabushiki Kaisha, Tokyo, Japan

[21] Appl. No.: 386,169

[22] Filed: Jul. 28, 1989

Related U.S. Application Data

[63] Continuation-in-part of Ser. No. 210,482, Jun. 23, 1988, abandoned.

[51] Int. Cl.[5] ..... F02D 41/26; F02D 41/34

[52] U.S. Cl. ..... 364/431.1; 123/435; 123/486

[58] Field of Search ..... 364/431.04, 431.05, 364/431.06, 431.1, 431.12; 123/435, 480, 486, 490, 491

[56] References Cited

U.S. PATENT DOCUMENTS

| | | | |
|---|---|---|---|
| 4,270,503 | 6/1981 | Pomerantz | 123/438 |
| 4,348,727 | 9/1982 | Kobayashi et al. | 364/431.06 |
| 4,348,728 | 9/1982 | Sagisaka et al. | 364/431.06 |
| 4,461,258 | 7/1984 | Becker et al. | 123/489 |
| 4,572,129 | 2/1986 | Otobe | 123/440 |
| 4,705,002 | 11/1987 | Ando et al. | 123/486 |
| 4,741,312 | 5/1988 | Ohishi | 123/486 |
| 4,850,324 | 7/1989 | Furuyama | 123/486 |
| 4,866,619 | 9/1989 | Iwaki | 364/431.05 |
| 4,905,155 | 2/1990 | Kanno | 364/431.05 |

*Primary Examiner*—Felix D. Gruber

*Attorney, Agent, or Firm*—Sughrue, Mion, Zinn, Macpeak and Seas

[57] ABSTRACT

An air-fuel ratio controller, including: fuel injection apparatus to supply an engine with fuel, a quantity of fuel to be delivered by the fuel injection apparatus being controlled by an impressed fuel quantity injection pulse having an injection time width corresponding to a desired fuel quantity; engine status detecting apparatus for detecting a status of at least one of a rotation frequency, intake manifold pressure, and volumetric efficiency operating parameter with respect to an operation of the engine; basic fuel quantity calculating apparatus for calculating a basic fuel quantity according to the status detected by the engine status detecting apparatus; air-fuel ratio sensor apparatus for detecting an air-fuel ratio in an exhaust gas from the engine; proportional integral processing apparatus for integrally processing and calculating an actual fuel quantity according to the output from the air-fuel ratio sensor apparatus; learning apparatus for calculating, using an output from the integral processing apparatus, a learned value to correct the basic fuel quantity into a controlled fuel quantity; learned value correcting apparatus for correcting the basic fuel quantity by using the learned value from the learning apparatus; and, calculation prohibiting apparatus for prohibiting the learning apparatus from calculating until a predetermined time lapses after the engine starts, or until a predetermined time lapses after an engine cooling water temperature is detected to have reached a predetermined temperature level.

6 Claims, 10 Drawing Sheets

AIR-FUEL RATIO CONTROLLER

CROSS-REFERENCE TO RELATED PATENT APPLICATION

This patent application is a continuation-in-part of U.S. patent application Ser. No. 210,482 filed on June 23, 1988 and now abandoned.

BACKGROUND OF THE INVENTION

1. Field of the Invention

The present invention relates to an air-fuel ratio controller for engines installed in vehicles.

2. Detailed Description of the Prior Art

A conventional air-fuel ratio controller controls quantity of fuel to be injected, using a pressure sensor to detect the pressure level of an intake manifold area downstream from a throttle valve, or a throttle valve opening level sensor for acquiring information about the opening level thereof.

As a concrete procedure, the conventional air-fuel ratio controller controls a quantity of fuel to be injected from an injector having an electromagnetic type fuel injecting valve, by using the width of a pulse being impressed to it by the indirect calculation of the above-mentioned pressure level of the intake manifold or the information about the throttle valve open level.

Also, such a conventional air-fuel ratio controller is provided with a systematic learning function for correcting an error in the value detected by the pressure sensor or the throttle valve opening level sensor, or a valve clearance error, considering a change in the value of air supplied to the engine in accordance with a valve clearance of the engine, and even in the open-loop mode in which the air-fuel ratio feed-back control is not performed, the basic fuel quantity is corrected to a controlled injecting quantity by the value calculated by this learning function so as to improve the precision in an air-fuel ratio.

In the above conventional controller, since the valve clearance of the engine changes its state according to the variation of the temperature thereof, if the learning function starts immediately after the engine starts, the error in the valve clearance becomes great as the temperature of the engine is not stabilized yet.

Thus, if the fuel quantity to be injected in the open loop mode, which is predetermined based on the temperature-stabilized state of the engine, is corrected by the pulse width representing a fuel injecting quantity which is calculated while the temperature of the engine is not stabilized yet (such as the moment immediately after the engine starts), then the air-fuel ratio will be abnormal, and an air quality of the exhaust gas or drivability becomes inferior.

SUMMARY OF THE INVENTION

According to the present invention which is performed so as to solve the above problems, the learning function is prohibited until the predetermined condition is fulfilled after the engine starts, so as to provide an air-fuel ratio controller of higher precision.

The air-fuel ratio controller according to the present invention comprises a learning means for calculating a value learned to correct the basic quantity of the fuel to be injected to the controlled one, and a calculation prohibiting means for prohibiting the learning means from functioning until the predetermined condition is fulfilled.

In the present invention, the calculation prohibiting means prohibits the learning means from functioning until the predetermined condition is fulfilled, and the learning means is permitted to start functioning for finally renewing the air-fuel ratio once the above predetermined condition is fulfilled.

The above and other objects, features and advantages of the present invention will become apparent from the following description and the appended claims, taken in conjunction with the accompanying drawings.

DETAILED DESCRIPTION OF THE PREFERRED EMBODIMENTS

Figure 1:
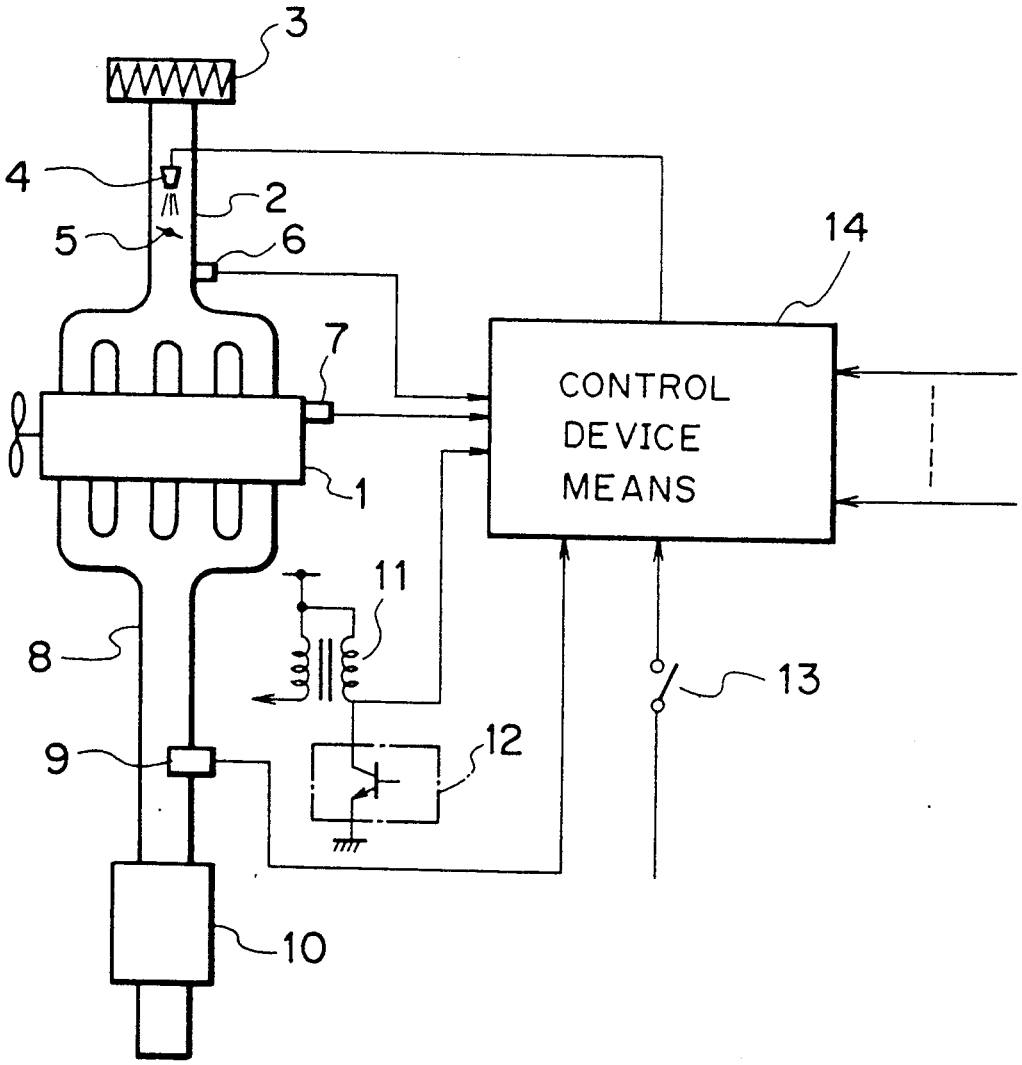
FIG. 1 is a block diagram showing a first embodiment of the present invention.

FIG. 1 shows a partial block diagram figure illustrating a first embodiment.

In FIG. 1, 1 denotes a known engine installed in vehicles, 2 an intake manifold for the engine 1, 3 an air cleaner installed at the entrance of the intake manifold 2, 5 a throttle valve to adjust the quantity of air supply for the engine 1, 6 a pressure sensor to detect a minus pressure appearing in the downstream portion of the intake manifold, the negative engine pressure being detected in absolute value. Component 7 is a cooling water temperature sensor to detect the temperature of the cooling water for the engine 1, 8 an exhaust manifold for the engine 1, 9 an air-fuel ratio sensor to detect the density of the oxygen in the exhaust gas flowing inside the manifold 8, 10 a ternary-catalyst filter to clean the exhaust gas, 11 an ignition coil to supply a spark plug (not shown) of the engine 1 with high voltage, 12 an igniter to supply the coil 11 with electric power, 13 a cranking switch that creates an on-pulse signal when a starter (not shown) for starting the engine 1 is powered on.

Component 14 is a control device in which various judgments and calculations are performed by various parameters inputted from the engine 1 for calculating the learned value or the pulse width for fuel injection.

The internal structure of the above control device 14 is explained as follows in reference to FIGS. 2 and 3.

Figure 2:
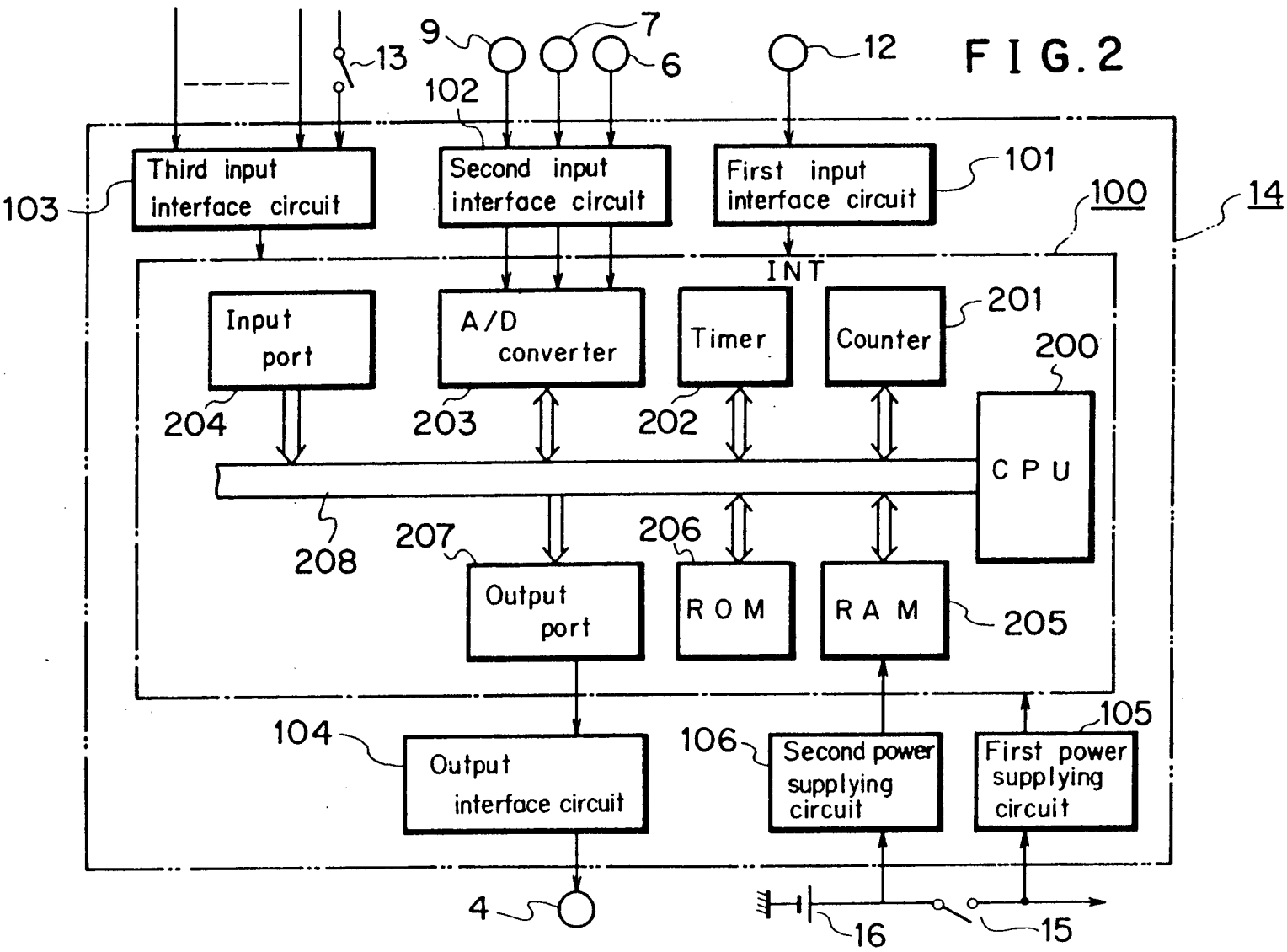
FIG. 2 is a block diagram showing the control device shown in FIG. 1.
Figure 3:
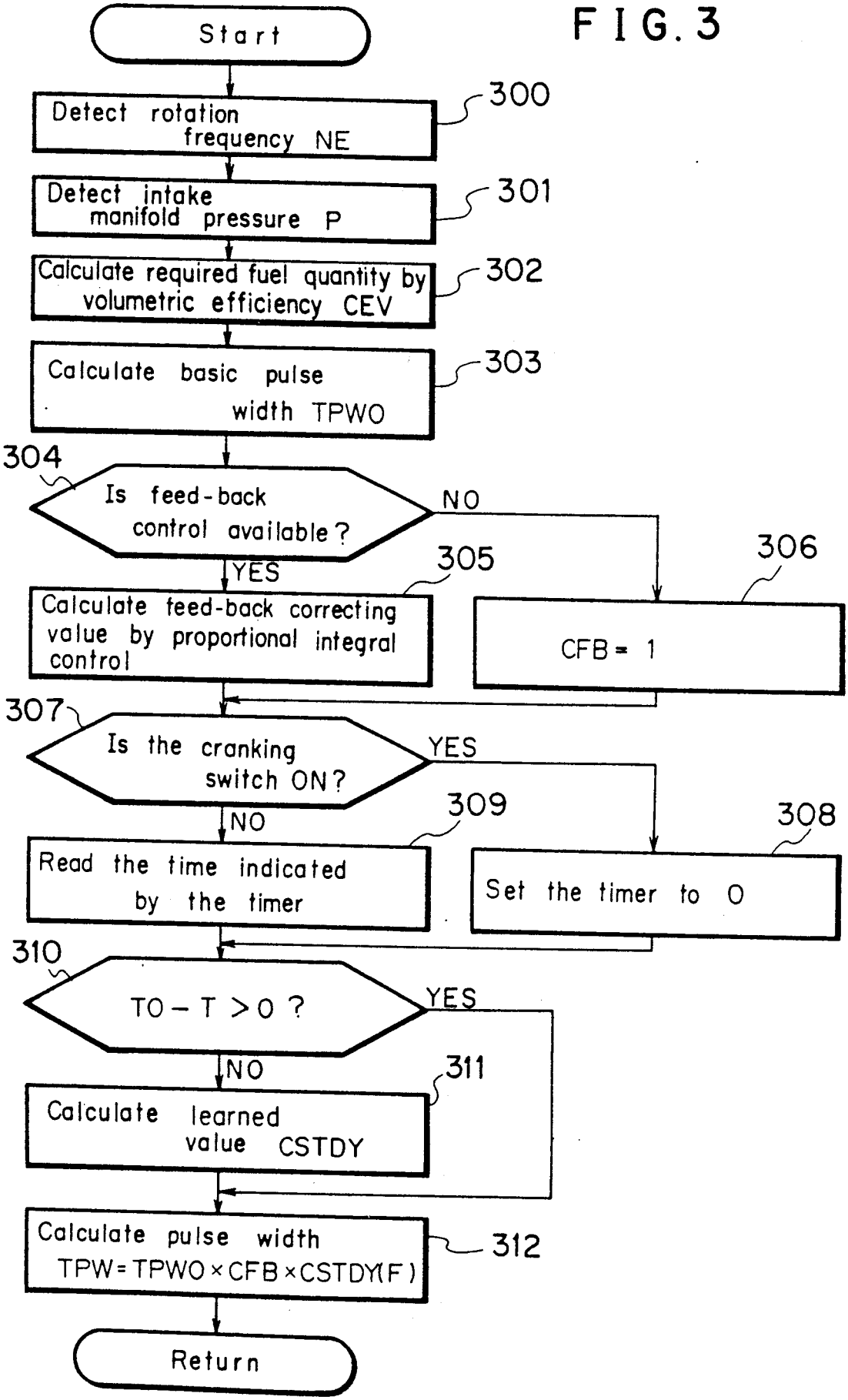
FIG. 3 is a flow chart showing the function of the CPU.

In FIG. 2, 100 denotes a microcomputer composed of a CPU 200 to execute the flow chart shown in FIG. 3, a counter 201, a timer 202, an A/D converter 203 to convert analog signals to digital signals as they are, a dynamic RAM 205 used for working memory or for storing the learned value by a constant power supply, a ROM 206 storing a program for executing the proceeding described in the flow chart in FIG. 3, an output port 207 to output the calculated fuel quantity to be injected, and a common bus 208 to electrically connect all the above components.

Component 101 denotes a first input interface circuit which is connected to the collector of the transistor in the igniter 12 which in turn is connected to the ignition coil 11, and inputs, for example, an engine rotation frequency detecting signal to the microcomputer 100. Component 102 denotes a second input interface circuit to input analog signals received from the pressure sensor 6, the cooling water temperature sensor 7, and from the air-fuel ratio sensor 9, to the A/D converter 203. Component 103 denotes a third input interface circuit to input various kinds of other signals such as those from cranking switches 13 to the microcomputer 100. Component 104 denotes an output interface circuit to output the fuel quantity to be injected to the injector 4 by converting it to a pulse of the width corresponding to the fuel injecting time. Component 105 denotes a first power supplying circuit which supplies the microcomputer 100 with electric power and is connected to the battery 16 through the key switch 15. Component 106 denotes a second power supplying circuit as a backup power supply which is adapted to maintain the stored contents inside the RAM 205 and is constantly connected to the battery 16.

The description of the function of the CPU 200 inside the microcomputer 100 and the whole structure thereof is as follows.

Firstly, when the key switch 15 is powered on, the microcomputer 100 is supplied with electric power from the battery 16 through the first power supplying circuit 105, which enables the control device 14 to start operation and executes a flow chart of the main routine (not shown). For example, an interrupt is created per rotation of the engine to stop execution of the flow chart of the main routine, and executes an interrupting process routine which is shown in FIG. 3.

At first in the step 300, a change in the signal from the igniter 12 with the ignition coil 11 powered on is inputted through the first input interface circuit 101 and the time interval between the previous ignition and that of this time is measured by a timer 202 for calculating the rotation frequency NE of the engine 1.

Then in the step 301, the intake manifold pressure signal outputted from the pressure sensor 6 is read through the second input interface circuit 102 and the A/D converter 203 for analog/digital conversion of the intake manifold pressure P.

In the following step 302, the numeral corresponding to the volumetric efficiency CEV is calculated. The volumetric efficiency CEV is experimentarily settled as a function of the rotation frequency NE of the engine and the intake manifold pressure, in accordance with the signals showing calculated rotation frequency NE and intake manifold pressure P respectively.

The volumetric efficiency CEV is in relation to other coefficients in the following formula (1):

$$Q = KA \times P \times CEV \quad (1)$$

wherein Q represents a quantity of the air-intake per cylinder of the engine 1, KA a coefficient acquired in compliance with cylinder volume or the like of the engine 1, and P represents an intake manifold pressure.

Now that the value Q is calculated as above, if the value of a target air-fuel ratio A is settled in accordance with the formula (2) as below, the required fuel B to be supplied at the moment can be calculated, and accordingly the basic pulse width TPWO is calculated.

$$A = \frac{Q}{B} \therefore B = \frac{Q}{A} \quad (2)$$

Here, the target air-fuel ratio A is predetermined and stored in the ROM 206 as a function of the intake manifold pressure and the rotation frequency of an engine, which is normally settled in the region of normal theoretical air-fuel ratio 14.7

Thus, the basic pulse width TPWO representing a basic fuel injecting time interval is calculated in the following step 303, and thus obtained result is stored in the RAM 205.

In the following step 304, it is judged whether or not the air-fuel ratio sensor 9 is in an active state, or whether or not the air-fuel ratio feed-back condition is available as dependent on a temperature level of the cooling water temperature WT or the like detected by the cooling water sensor 7.

Figure 5:
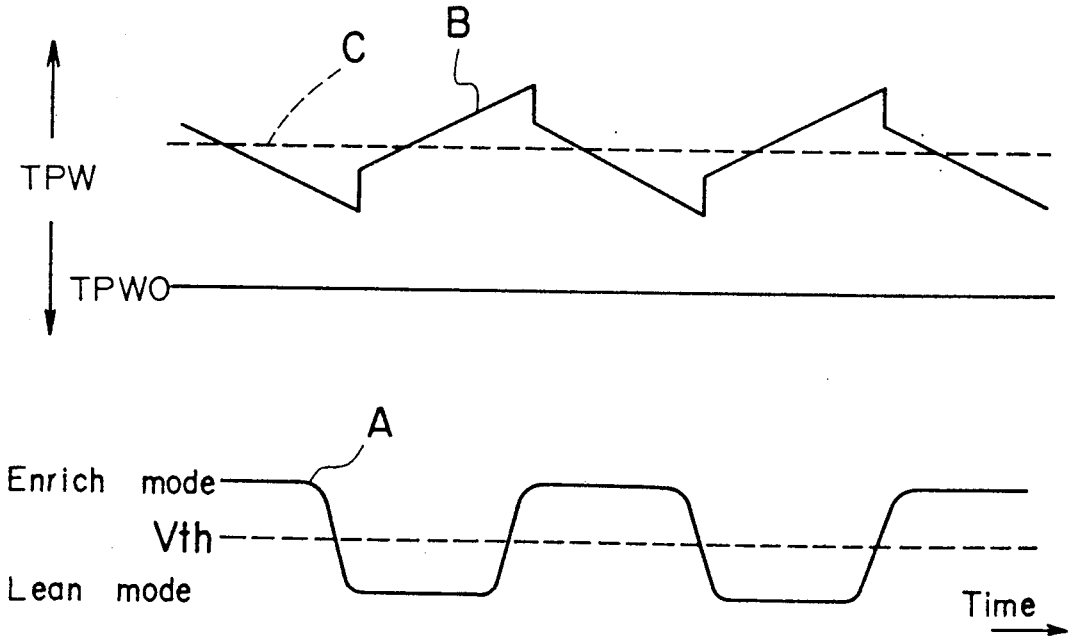
FIG. 5 shows an output waveform of the air-fuel ratio sensor and that of the pulse width of the injector.

If the feed-back control is possible in the step 304, a feed-back correcting value CFB of the fuel injecting time is calculated in the next step 305 by processing a proportional integral (PI) in accordance with the output value of the air-fuel ratio sensor 9 which is in the lean mode or the rich mode as shown in FIG. 5.

In other words, if the output value of the air-fuel ratio 9 shows the enriched state, the feed-back correcting value CFB is calculated to gradually decrease toward the lean mode, and if it is leaned, the CFB is calculated to gradually increase toward the enriched state, respectively, by the CPU 200 so as to be controlled by a proportional integral processing.

On the other hand, if the feed-back control is impossible in the step 304, in other words, if it is in the open loop mode, the feed-back correcting value CFB is set equal to 1 (CFB=1) in step 306.

In the step 307 following either the step 305 or 306, it is judged whether the cranking switch 13 is turned on from off.

If the cranking switch 13 is turned on, in the step 308 the timer 202 is set to 0 to prohibit the learning function from operating for a certain time (TO) after the engine 1 starts, as the engine starting operation has just started. If the cranking switch 13 is not changed to on, i.e., indicating that a certain time has already passed since the engine started, the time T indicated by the timer 202 is read in the step 309.

In the step 310, which follows either after the step 308 or 309 it is judged whether or not the value, figured out by subtracting the time T indicated by the timer 202 from the predetermined learning prohibiting time TO, is bigger than 0 ($TO-T>0$). In this case if the resultant value is bigger than 0, it is still within the learning prohibiting time TO, wherein the temperature of the engine 1 is unstable, and consequently the error in the learned value becomes great, so that the learning function is not performed in this step, and the procedure goes to the next step 312.

On the other hand, if $TO-T \leqq 0$, as learning prohibiting time TO has passed already after the engine started, the valve clearance is stabilized due to the stabilization of the temperature of the engine 1, so that an error in the learned value to correct the valve clearance error or the like is greatly reduced, and the procedure goes to the step 311.

In this step 311, the newly learned value CSTDY is calculated utilizing the previously learned value CSTDY(F) (or the predetermined learned value as the initial value) and the forgoing feed-back correcting value CFB figured out by proportional integral processing, and the thus obtained result of the calculation is stored in the RAM 205.

The detailed explanation of how to figure out the above learned value CSTDY is given below in reference to FIG. 5.

In FIG. 5, the irregularly curved line B, which shows a corrected basic pulse width in accordance with the output voltage from the air-fuel ratio sensor is calculated by the following formula (3).

$$TPW = TPWO \times CFB \times CSTDY(F) \quad (3)$$

On the other hand, the value of the straight line C, which is a leveled line of the above curved line B, is calculated by the following formula (4).

$$TPW = TPWO \times CSTDY \quad (4)$$

Thus, the following equation (5) is calculated in reference to the above equations (3) and (4)

$$CSTDY = CFB \times CSTDY(F) \quad (5)$$

Accordingly the value of the CSTDY is changed in accordance with that of the CFB, and thus following relations are effected such as;

If $CFB > 1.0$, then $CSTDY = CSTDY(F) + k$

If $CFB < 1.0$, then $CSTDY = CSTDY(F) - k$

If $CFB = 1.0$, then $CSTDY = CSTDY(F)$

Here, CSTDY(F) shows the previously learned value as mentioned before, and k represents a learned value correcting coefficient which is normally a determined value, for example, 0.2% of the CSTDY(F).

The detailed explanation of the above conditions is as follows;

When the CFB is corrected inclined to the rich mode (CFB > 1.0), the learned value is enriched by 0.2% at every 50 msec, and when it is corrected inclined to the lean mode (CFB < 1.0), the learned value is conversely made lean by 0.2% at every 50 msec. If the CFB is just 1.0, then the newly learned value can be considered as same as the previously learned value, thus no change occurs.

By the above method, learned value CSTDY is constantly calculated in such a manner that the feed-back correcting value CFB accesses to the value 1.0.

After the calculation above, the procedure returns to the main routine (not shown in Figures).

By the way, when the procedure advances from the step 310 directly to the step 312, the learned value CSTDY initiated by the initiating routine (not shown in Figures) is used when it is powered on.

The signal indicated by the pulse width (TPW) thus calculated is sent to the injector 4 through the output port 207 and the output interface circuit 104, so that the injector 4 is activated to supply the engine 1 with fuel during the time indicated by the pulse width TPW.

The air-fuel ratio for the engine 1 is controlled by repeating the above operation.

Figure 4:
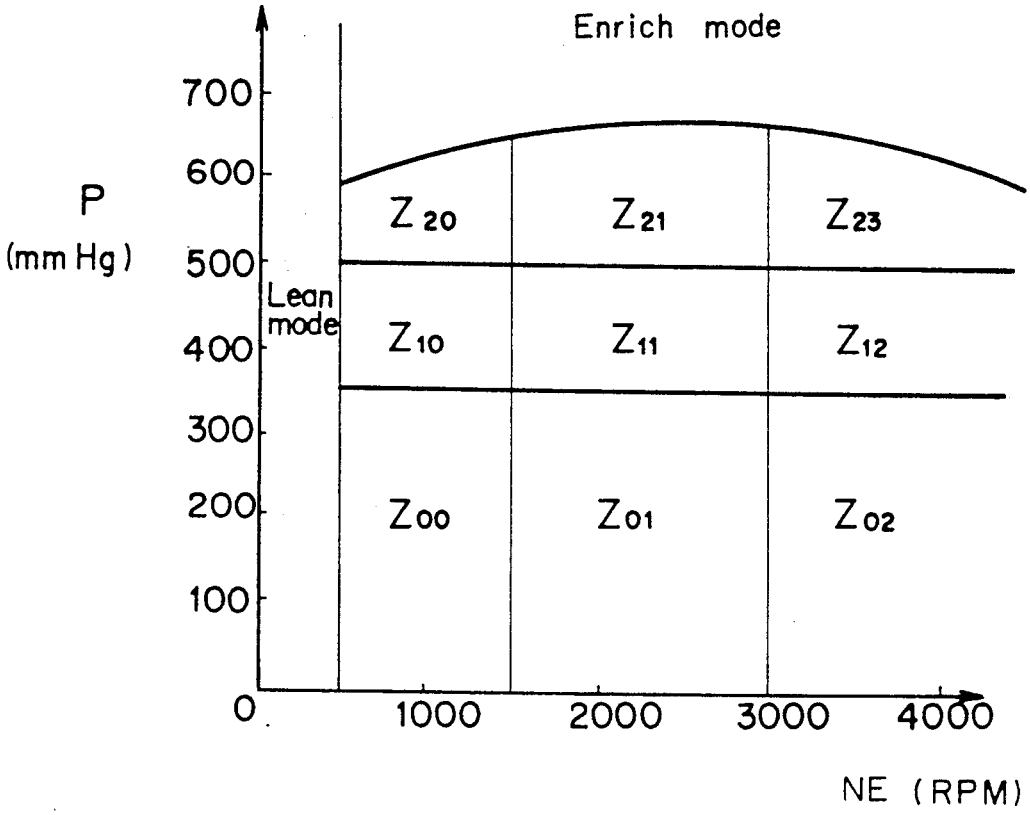
FIG. 4 is an explanatory view to indicate driving modes.

The basic method of calculating a newly learned value CSTDY in the step 311 is already heretofore explained, and here more detailed explanation thereabout is given in reference to FIGS. 4 and 5 so as to be fully understood.

Referring to FIG. 4, the X-axis shows the rotation frequency of the engine NE, and the Y-axis shows intake manifold pressure P. Also, Z00–Z23 show various driving modes wherein the feed-back control can be performed, and the learned value predetermined at the initial state and the newly learned value are calculated in accordance with these driving modes Z00–Z23 and stored in the RAM 205.

By the way, the area where the intake manifold pressure P is higher than the driving modes Z00–Z23 shows a rich mode where the open loop control is performed, but even in this area, the learned value CSTDY calculated per the above procedure is used for controlling the air-fuel ratio.

In FIG. 5, the horizontal axis (X-axis) shows a time. The irregularly curved line B represents a pulse width corresponding to the fuel to be injected which is controlled by proportional integral processing means, and calculated in accordance with another curved line A which represents the change in output voltage from the air-fuel ratio sensor 9 as shown in FIG. 1.

Here, Vth represents a judging line used to determine whether the pulse width is inclined to the rich mode or to the lean mode. Further, the dotted straight line C is a leveled line of the above curved line B.

The curved line B is calculated by the formula (3), and the CSTDY(F)(previously calculated learned value) is read out by the CPU 200 from the RAM 205 according to the new rotation frequency of the engine NE and the intake manifold pressure P. The pulse width equal to the fuel injecting quantity represented by the straight line C is calculated by the equation (4).

The details about the relation between the line A representing the output voltage from the air-fuel sensor 9 and the line B representing the pulse width corresponding to the fuel quantity to be injected calculated by the proportional integral processing is as follows.

As described above, the feed-back correcting value CFB is a very important factor for forming the line B, but the CFB is controlled in accordance with the output voltage from the air-fuel ratio sensor 9.

In other words, when the above voltage is inclined towards the rich mode, the CFB is calculated to be inclined to the lean mode side, and when the above voltage is inclined towards the lean mode, the CFB is calculated to be inclined adversely to the rich mode, so as to be respectively controlled by the proportional integral processing operation.

Once a value of the above CFB is settled, the value of a newly learned CSTDY is calculated at every predetermined time interval in accordance with the above CFB and the CSTDY(F), wherein the CFB is calculated in such a manner as to access to the value 1.0 so that it can be stored as the newly learned value in the RAM 205 in accordance with the value of revolution frequency of the engine NE and the intake manifold pressure P.

Figure 6:
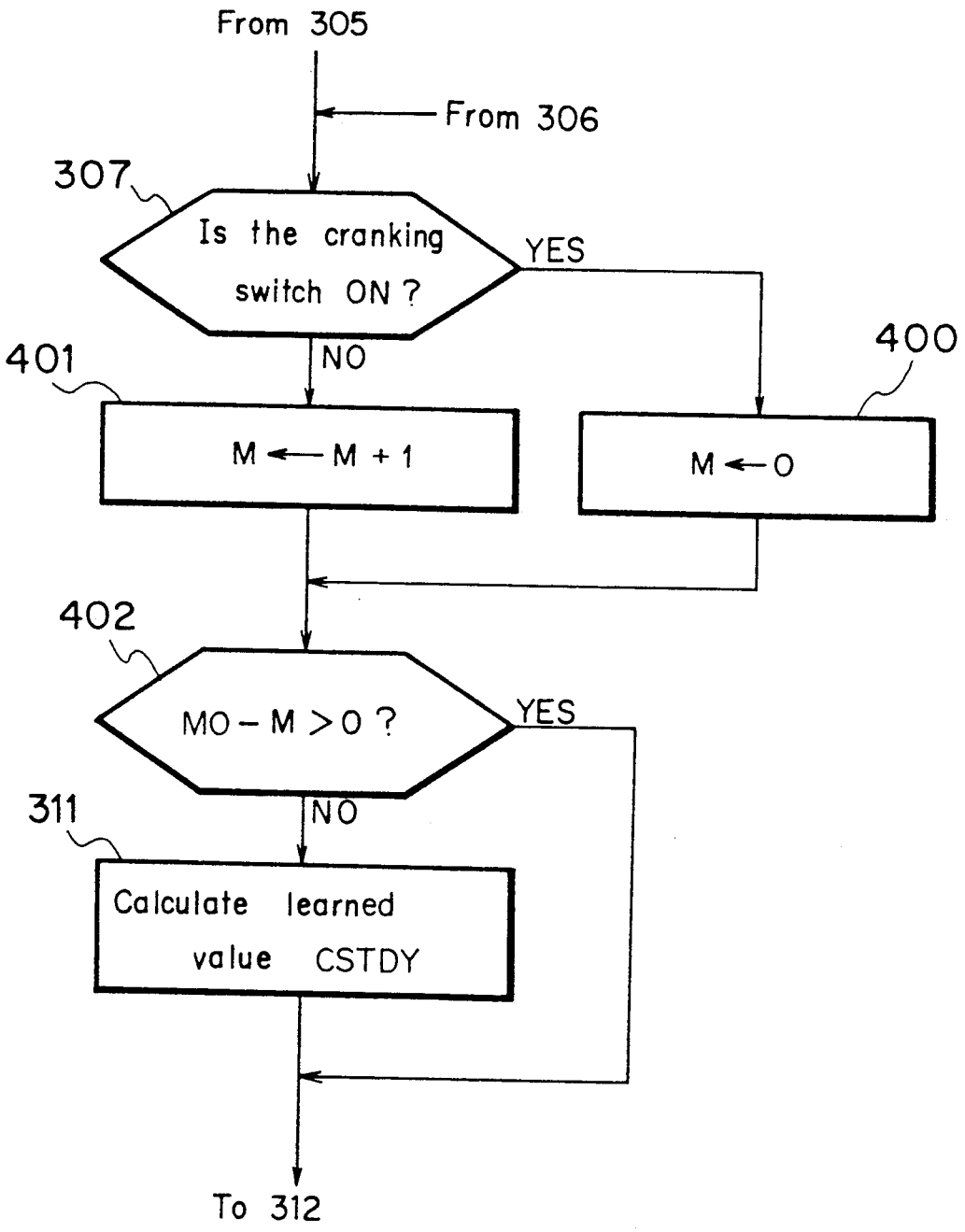
FIGS. 6 and 7 are partial flow charts showing a second and a third embodiment, respectively.

FIG. 6 shows a part of the flow chart indicating the second embodiment, which differs from the first embodiment in that the ignition frequency M of the igniter 12 is used instead of the predetermined time TO.

In the step 307, it is judged whether the cranking switch 13 is turned on from the off state. When the cranking switch 13 is turned on from the off, as the engine starting operation has just started, the ignition frequency M of the counter 201 is set to 0 in the step 400, but conversely, when the cranking switch 13 is turned off from on, i.e., indicating that a certain time has already passed, 1 is added to the previous ignition frequency M of the counter 201 in the step 401 to renew the ignition frequency M.

In the step 402, which is the step following either the step 400 or 401 it is judged whether or not the value output by subtracting the ignition frequency M from the predetermined frequency MO of the learning prohibiting ignition is more than 0 ($MO-M>0$). If the resultant value is more than 0, indicating that it is still within the frequency of the learning prohibiting ignition MO, the procedure advances to the step 312, whereas if the value is 0 or less than that ($MO-M\leqq 0$), the procedure advances to the step 311, thereby the learned value CSTDY is calculated.

By the way, since other steps from "start" to "return" are the same as those indicated in FIG. 3, they are not explained here.

Figure 7:
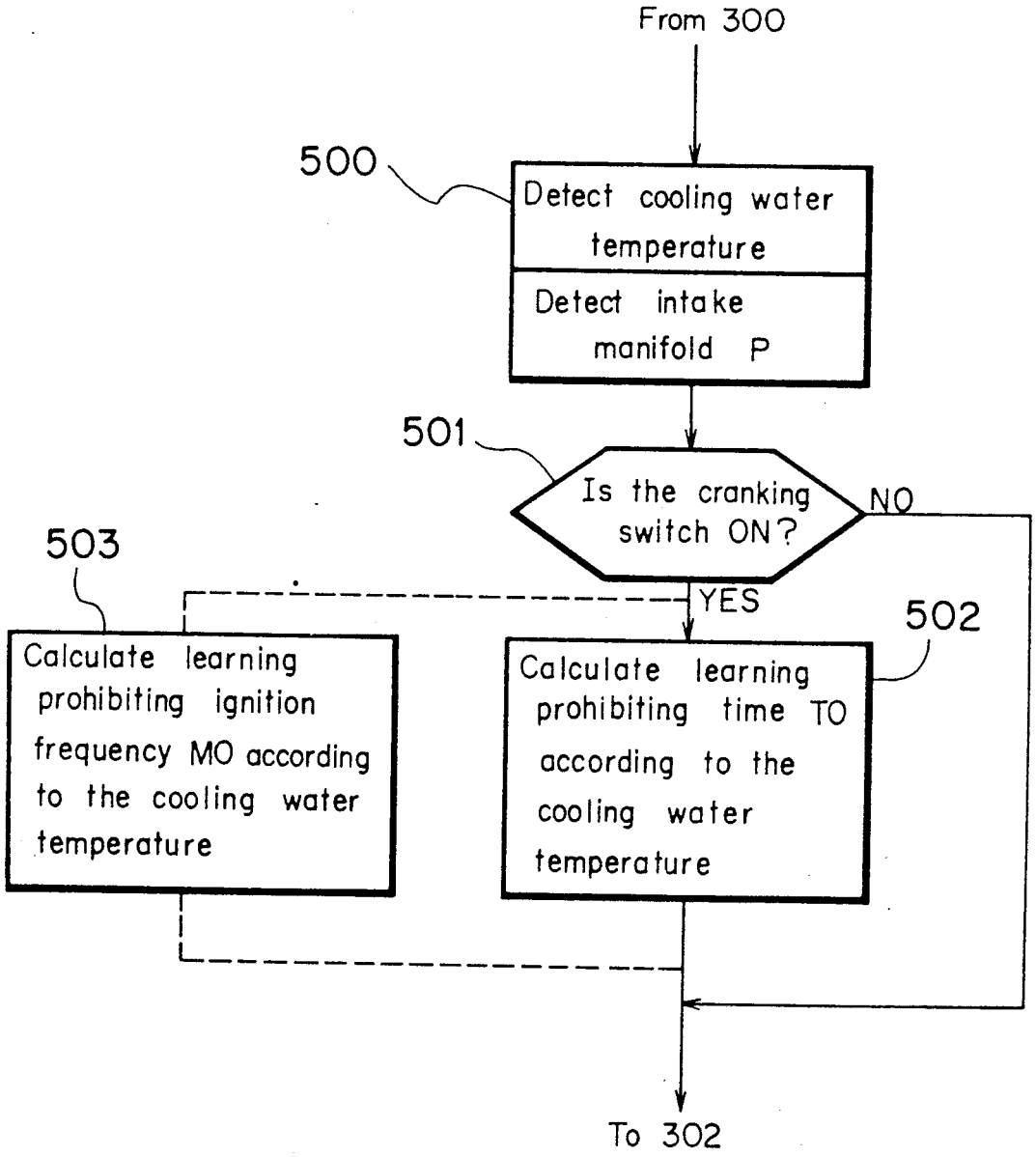

FIG. 7 shows a part of the flow chart showing a third embodiment, which differs from the first embodiment in that the learning prohibiting time TO varies according to the cooling water sensor 7 after the engine 1 has started.

Following are the detailed functions performed in this third embodiment.

In the step 500 following the step 300, the cooling water temperature WT of the engine 1 is read out by the cooling water temperature sensor 7, and the intake manifold pressure P is read by the pressure sensor 6.

In the next step 501, it is judged whether the cranking switch is on or off. If the cranking switch 13 is on, as the starting operation of the engine 1 has just started, the learning prohibiting time TO is set in accordance with the cooling water temperature WT already read out in the step 500, and calculated in such a manner that the lower the cooling water temperature WT is, the longer the learning prohibiting time TO becomes.

In the same step 501, if the cranking switch 13 is off, or after the step 502 is performed, the procedure advances to the step 302, and the learning prohibiting time TO calculated in the above manner is used in the step 310 as shown in FIG. 3.

Since other steps from "start" to "return" are same as those indicated in FIG. 3, they are not explained here.

In the third embodiment, instead of the step 502, where the learning prohibiting time TO is calculated, the step 503 can be used, so that the frequency of learning prohibiting ignition MO is set according to the cooling water temperature WT in such a manner that the lower the temperature WT is, the higher the frequency MO becomes, which can be utilized in the second embodiment as well. The frequency of learning prohibiting ignition MO thus calculated is used in the step 402 shown in FIG. 6.

Figure 8:
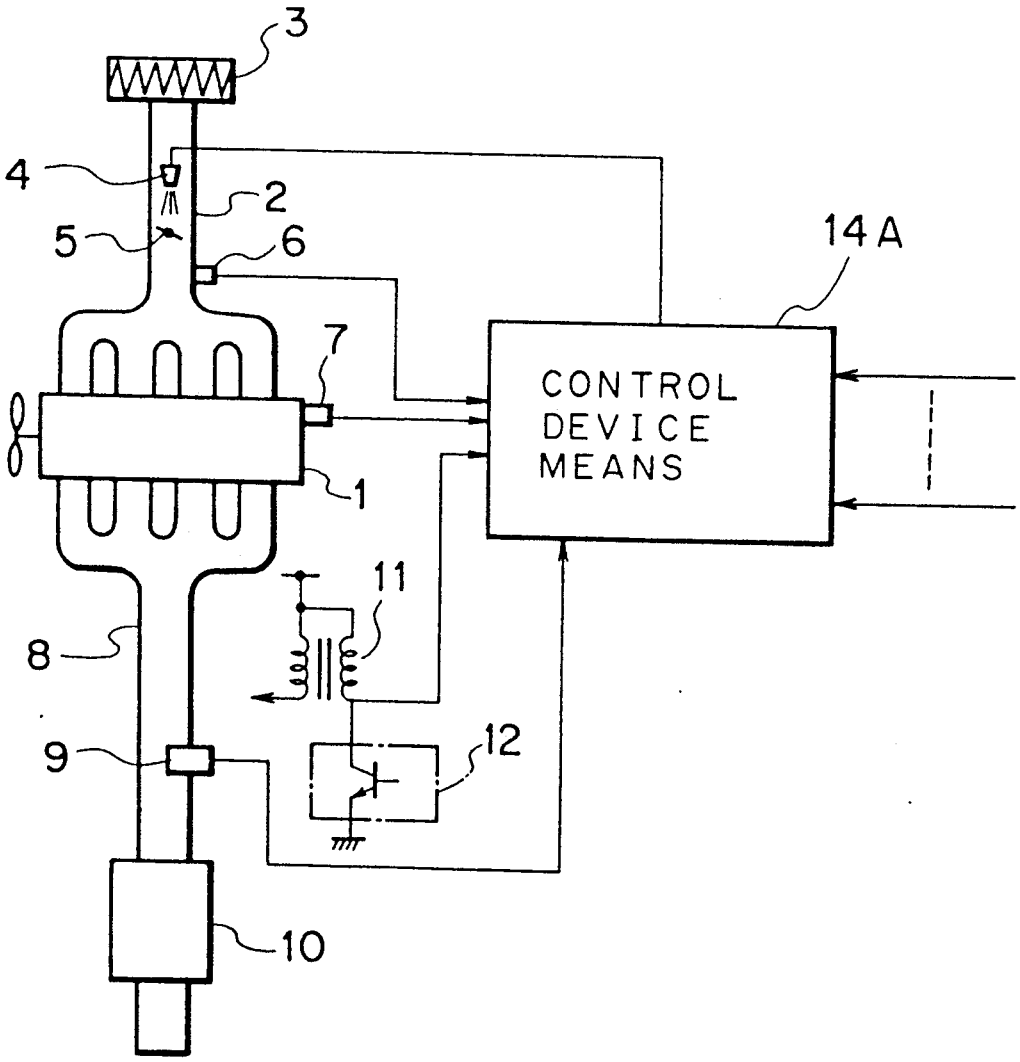
FIG. 8 is a block diagram showing a fourth embodiment according to the present invention.

FIG. 8 shows the structure of a fourth embodiment. In FIG. 8, components which are the same portion as those indicated in FIG. 1 have same assigned reference number and the characteristic part of the fourth embodiment is as shown below.

Component 14A is a control device, in which various judgments and calculations are performed by various parameters inputted from the engine 1 to deduce the learned value or the pulse width for fuel injection.

Below is an explanation of the internal configuration of the above control device 14A in reference to FIGS. 9 and 10.

Figure 9:
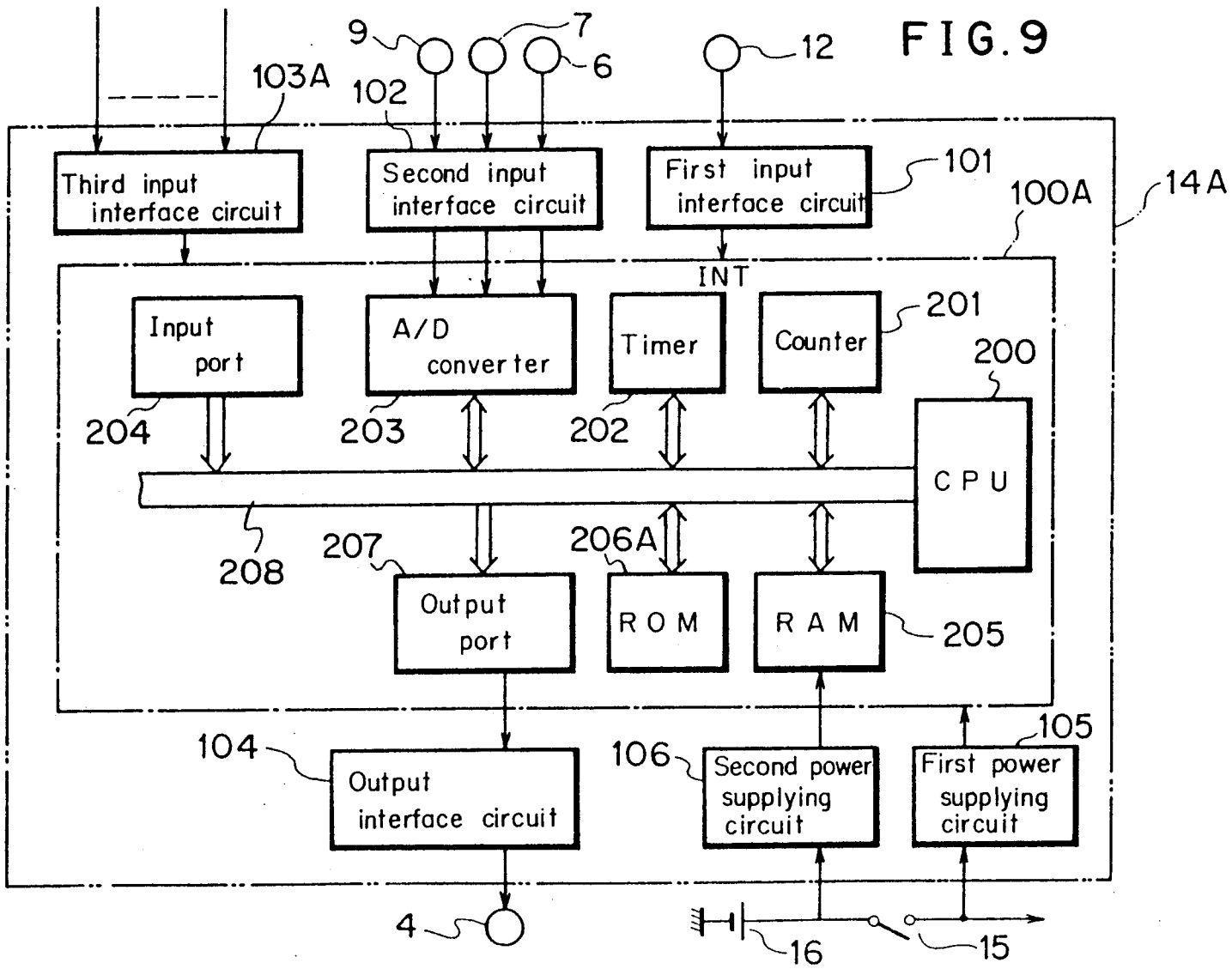
FIG. 9 is a block diagram showing the structure of the control device shown in FIG. 8.

In FIG. 9, components which are the same portion as those indicated in FIG. 2 have the same assigned reference number, and its characteristics are as follows.

Figure 10:
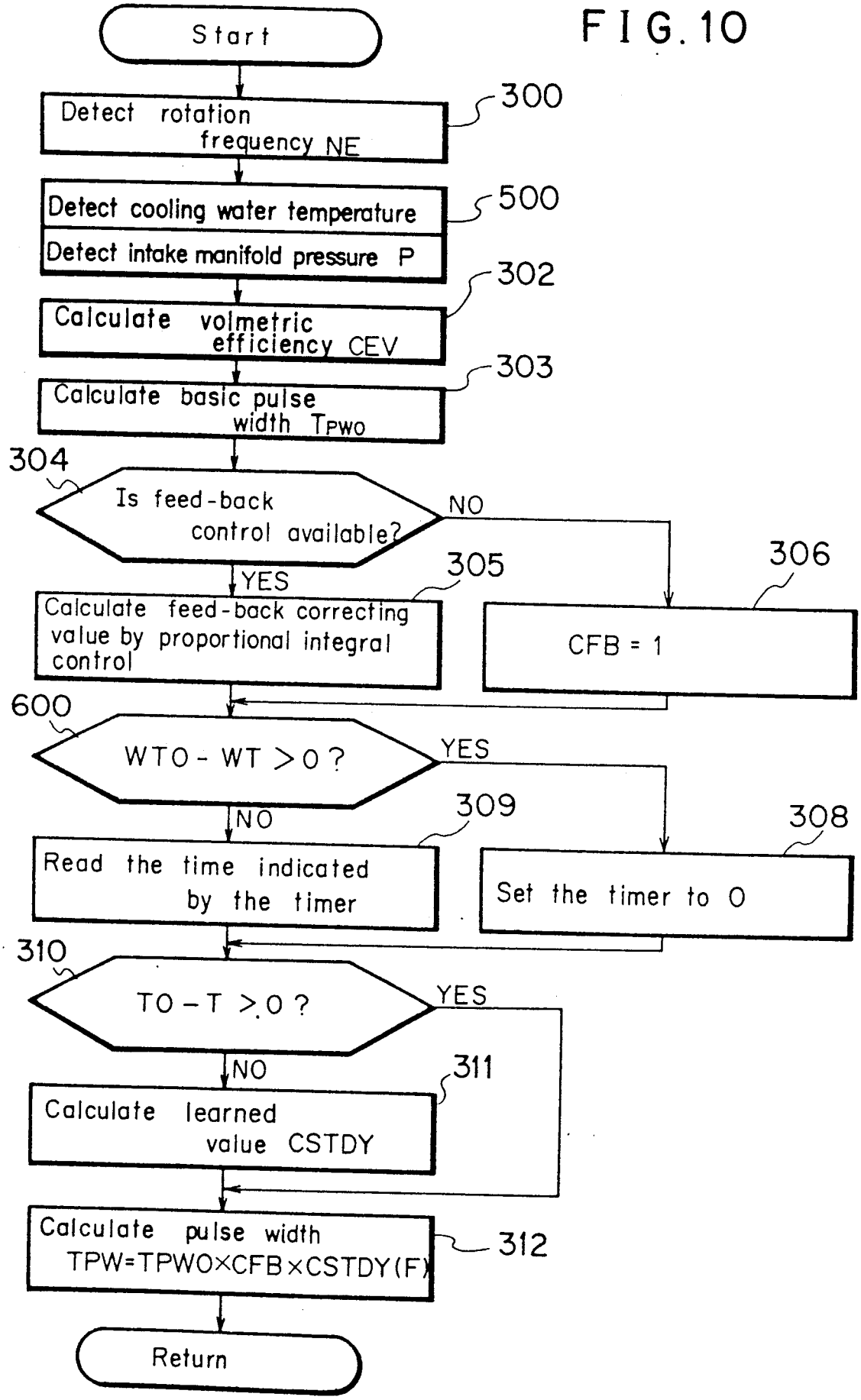
FIG. 10 is a flow chart showing the operation of the CPU.

Component 100A denotes a microcomputer composed of CPU 200, a counter 201, a timer 202, an A/D converter 203 to convert analog signals to digital signals, an input port 204 to input digital signals as they are, a dynamic RAM 205 used for working memory or for storing the learned value by a constant power supply, a ROM 206A storing a program for executing the process described in the flow chart shown in FIG. 10, an output port 207 to output the calculated fuel quantity to be injected, and a common bus 208 to electrically connect all the above components.

Component 103A is a third input interface circuit to input various signals to the microcomputer 100A.

Below shows the operation executed by the CPU 200 in the microcomputer 100A, as well as its structural operation as a whole, whereas steps in FIG. 10 are not explained here which are the same numbered steps as those indicated in FIGS. 3 and 7 and which have already been explained.

In the step 600 following the step 305 or 306, it is judged whether the value figured out by subtracting the detected cooling water temperature WTO is more than 0 ($WTO-WT>0$). If the above calculated value is more than 0 ($WTO-WT>0$), it means that the temperature of the cooling water WT is not warm enough yet since the engine starting operation has just started, so that the procedure advances to the step 308 to set the timer 202 to 0.

On the other hand, if the above calculated value is 0 or less than that ($WTO-WT\leqq 0$), the temperature of the cooling water WT is substantially warmed as a certain time has already passed since the engine started, so that the procedure advances to the step 309 to read the time indicated by the timer 202.

Figure 11:
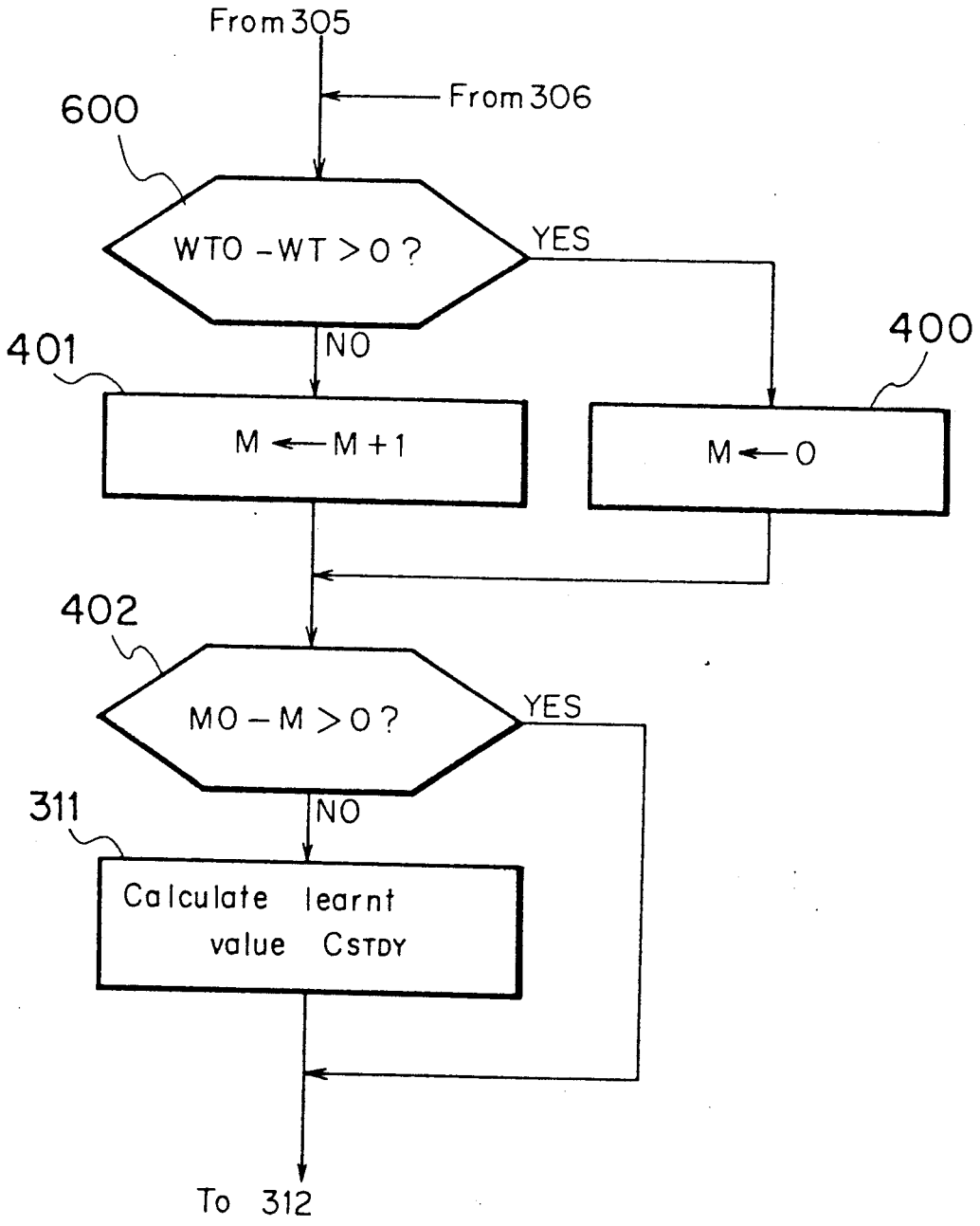
FIG. 11 is a partial flow chart showing a fifth embodiment of the present invention.

FIG. 11 shows a part of the flow chart indicating a fifth embodiment, although previously explained steps are not explained here, as they correspond to the same numbered steps indicated in FIG. 6 and 10 which are already explained before.

The fifth embodiment differs from the fourth embodiment in that frequency of the ignitions M of the ignition 12 is used instead of the learning prohibiting time TO.

By the way, instead of the cranking switch 13 used as its start detecting means as shown in the above third embodiment, the fact that the key switch 15 is powered on or that the rotation frequency of the engine NE has reached the predetermined rotation frequency (for example 400 rpm) can be adopted. And also in the same case, information about the throttle valve 15 open level can be used instead of the intake manifold pressure P, after detecting its open level by the throttle valve 15 open level sensor.

Furthermore, each of the second, third and fifth embodiment has been heretofore explained referring either to first or second embodiment, but as a matter of fact, each of these embodiments is performed by a flow chart describing a process executed by the program which is stored in the ROM provided in each control device.

What is claimed is:

1. An air-fuel ratio controller comprising:

fuel injection means to supply an engine with fuel, a quantity of fuel to be delivered by said fuel injection means being controlled by an impressed fuel quantity injection pulse having an injection time width corresponding to a desired fuel quantity;

engine status detecting means for detecting a status of at least one of a rotation frequency, intake manifold pressure; and a controller including basic fuel quantity calculating means for calculating a basic fuel quantity according to said status detected by said engine status detecting means;

air sensor means for detecting an air-fuel ratio in an exhaust gas from said engine;

proportional integral processing means for integrally processing and calculating an actual fuel quantity according to the output from said air sensor means;

learning means for calculating, using an output from said integral processing means, a learned value to correct said basic fuel quantity into a controlled fuel quantity;

learned value correcting means for correcting said basic fuel quantity by using said learned value from said learning means; and calculation prohibiting means for prohibiting said learning means from calculating until a predetermined time lapses after the engine starts.

2. An air-fuel ratio controller comprising:

fuel injection means to supply an engine with fuel, a quantity of fuel to be delivered by said fuel injection means being controlled by an impressed fuel quantity injection pulse having an injection time width corresponding to a desired fuel quantity;

engine status detecting means for detecting a status of at least one of a rotation frequency, intake manifold pressure; and a controller including basic fuel quantity calculating means for calculating a basic fuel quantity according to said status detected by said engine status detecting means;

air sensor means for detecting an air-fuel ratio in an exhaust gas from said engine;

proportional integral processing means for integrally processing and calculating an actual fuel quantity according to the output from said air sensor means;

learning means for calculating, using an output from said integral processing means, a learned value to correct said basic fuel quantity into a controlled fuel quantity;

learned value correcting means for correcting said basic fuel quantity by using said learned value from said learning means; and calculation prohibiting means for prohibiting said learning means from calculating until a predetermined time lapses after a cooling water temperature is detected to have reached a predetermined temperature value.

3. An air-fuel ratio controller as claimed in claims 1 or 2, wherein the lapse of predetermined time until said learning means starts calculation is measured by a timer.

4. An air-fuel ratio controller as claimed in claims 1 or 2, wherein the lapse of said predetermined time until said learning means starts calculation is measured using a timing frequency of ignition of said engine.

5. An air-fuel ratio controller as claimed in claims 1 or 2 further comprising;

engine start detecting means for detecting starting operation of said engine; and calculating means for calculating said predetermined learning prohibiting time in accordance with the temperature of said cooling water for said engine when the engine starting operation is detected by said detecting means.

6. An air-fuel ratio controller as claimed in claim 5, wherein said calculating means calculates said predetermined learning prohibiting time as a value of timing frequency of ignition of said engine.

* * * * *